United States Patent [19]

Grotloh

[11] 4,366,833

[45] Jan. 4, 1983

[54] STEAM THROTTLE VALVE

[75] Inventor: Karlheinz Grotloh, Winterthur, Switzerland

[73] Assignee: Sulzer Brothers Limited, Winterthur, Switzerland

[21] Appl. No.: 158,309

[22] Filed: Jun. 10, 1980

[30] Foreign Application Priority Data

Jun. 20, 1979 [CH] Switzerland ..... 5746/79

[51] Int. Cl.[3] ..... F16K 49/00

[52] U.S. Cl. ..... 137/334; 137/896; 366/165

[58] Field of Search ..... 137/334, 340, 896, 897, 137/898, 605; 251/121, 122; 366/144, 147, 148, 165, 167, 168, 171, 174, 176, 262, 266

[56] References Cited

U.S. PATENT DOCUMENTS 3,228,603 1/1966 Norman ..... 137/605
3,243,157 3/1966 Beck ..... 251/122
3,298,389 1/1967 Freeman ..... 251/122
3,964,516 6/1976 Purton et al. ..... 137/625.48
4,043,766 8/1977 Gernhardt et al. ..... 366/165

FOREIGN PATENT DOCUMENTS 1526977 3/1970 Fed. Rep. of Germany ..... 137/897

*Primary Examiner*—H. Jay Spiegel
*Assistant Examiner*—John A. Rivell, Jr.
*Attorney, Agent, or Firm*—Kenyon & Kenyon

[57] ABSTRACT

The steam throttle valve has water injection ducts disposed about the valve axis. The ducts are situated between two abutting flanges of a valve cage and a valve spindle guide. The ducts are in the form of grooves in the flange while the adjacent peripheral surface of the flange is plain. The valve cage forms a replaceable wearing component and the configuration of the water injection ducts avoids thermal stress cracks in the duct zone.

7 Claims, 5 Drawing Figures

STEAM THROTTLE VALVE

This invention relates to a steam throttle valve. More particularly, this invention relates to a caged steam throttle valve having cooling means therein.

Heretofore, it has been known, for example, as described in German A.S. No. 15 26 977, to construct a steam throttle valve with a valve cage downstream of a throttle cross-section and with a cooling water discharge zone which leads into a flow chamber between the throttle cross-section and openings in the valve cage. It has also been known to dispose an annulus concentrically of the valve axis in order to feed injection water near the valve seat of the valve. However, this results in intensive temperature changes at the valve seat and the valve head and leads to a rapid breaking up of the material of the seat and head due to thermal stresses. This trend is further intensified by the fact that the water emerges fron an annular gap which very shortly assumes unequal widths over the periphery due to unequal expansion during operation.

Accordingly, it is an object of the invention to avoid thermal stresses on the valve seat and valve head of a steam throttle valve in a structurally simple manner.

It is another object of the invention to provide a simple steam throttle valve construction which can be supplied with cooling water.

It is another object of the invention to provide a steam throttle valve in which cooling water can be injected without an increase in the temperature gradient at the valve seat.

It is another object of the invention to provide a steam throttle valve which can be readily repaired due to erosion or thermal shock damage.

Briefly, the invention is directed to a steam throttle valve having a valve body formed with a throttle cross-section on a valve axis about a valve seat, a valve spindle guide on the valve axis, and a perforated valve cage on the valve axis downstream of the throttle cross-section and concentrically about the spindle guide in order to define a flow chamber with the spindle guide.

In accordance with the invention, a contact surface and a plurality of ducts are formed between the valve cage and the spindle guide for directing cooling water into the flow chamber from an annulus which is disposed in concentric relation to the valve axis. The annulus receives cooling water from a suitable source and is in communication with the ducts in order to deliver the cooling water into the flow chamber.

The valve is of very simple construction and is operable without an increase in the temperature gradient at the valve seat. Further, damage due to erosion or thermal shock in the zone of the cooling water ducts can be readily repaired without any need for replacement of expensive parts, such as the valve body or a valve cover on the body.

In one embodiment, the contact surface is a cylindrical or conical surface of rotation on the spindle guide while the ducts are formed as grooves in a collar on the valve cage. This construction has a structural advantage in that any pitch errors in the production of the cooling water ducts become unimportant. This is because the two valve parts which abut at the contact surface are made independently from one another and one of the two parts is less subject to thermal stresses.

In accordance with the invention, the valve cage is removably mounted in the valve body. This provides a very simple structural unit because the valve cage then forms a wear component which can be readily dismantled.

In another embodiment, at least one thin-walled tubular member is mounted on one of the spindle guide or cage in order to define either the contact surface or the ducts. This reduces the effect of thermal shock in the cooling water discharge zone and generally reduces the thermal stresses.

In still another embodiment, at least one annulus can be disposed to define a trap for either stagnant water or stagnant steam in a zone adjacent the cooling ducts. This permits the thermal stresses produced by high heat transfer to be further reduced even in the solid parts of the valve.

These and other objects and advantages of the invention will become more apparent from the following detailed description and appended claims taken in conjunction with the accompanying drawings in which:

Figure 1:
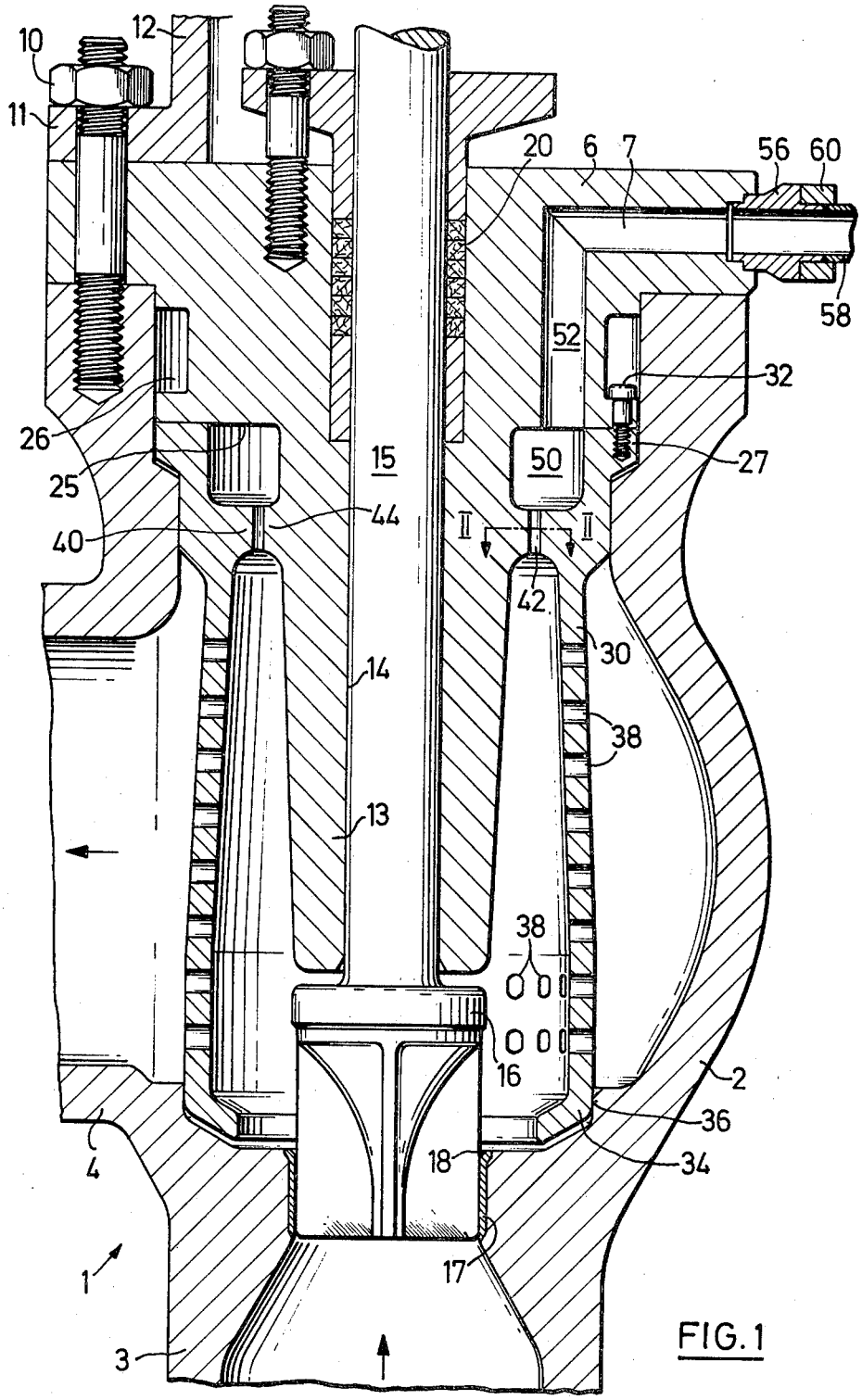
FIG. 1 illustrates an axial cross-sectional view of a steam throttle valve constructed in accordance with the invention.

Referring to FIG. 1, the steam throttle valve 1 is constructed of a valve body 2 having a steam inlet duct 3 and a steam outlet duct 4. The valve body 2 is shaped so as to define a throttle cross-section on a valve axis intermediately of the inlet duct 3 and outlet duct 4. In addition, the valve has a removable cover 6 which is sealingly connected to the valve body 2 by a number of bolts 10. The bolts 10 also hold a base flange 11 of an upright 12 for a servomotor (not shown). As shown, the cover 6 forms a spindle guide 13 on the axis of the valve in which an axial passage 14 is formed for movement of a valve spindle 15 therein.

The valve spindle 15 carries a valve head 16 which cooperates with a valve seat 18 formed on a hard metal coating or sleeve 17 on the valve body 2 adjacent the inlet duct 3. In addition, a gland packing 20 is provided in the top part of the cover 6, as viewed, to seal off a gap between the spindle 15 and passage 14.

A substantially cylindrical perforated valve cage 30 is disposed on the valve axis downstream of the throttle cross-section concentrically about the spindle guide 13 in order to define a flow chamber therebetween. This valve cage 30 is secured by bolts 32 to a shoulder 25 of the cover 6. As shown, the shoulder 25 is formed with a recess 26 in the cover 6. The opposite end 34 of the valve cage 30 is laterally guided in a recess 36 formed in the body 2. The middle zone of the valve cage 30 is provided with a plurality of passages 38 so as to permit a flow of steam through the valve when the valve head 16 is in an opened position.

As shown, the cover 6 has a water feed duct 7 which connects with a head 56 of a water feed pipe 58 for receiving a supply of cooling water from a suitable source (not shown). As indicated, the feed pipe 58 is fitted to the orifice of the passage 7 and is laterally pressed against the cover 6 by a bridge 60 via bolts (not shown).

Figure 2:
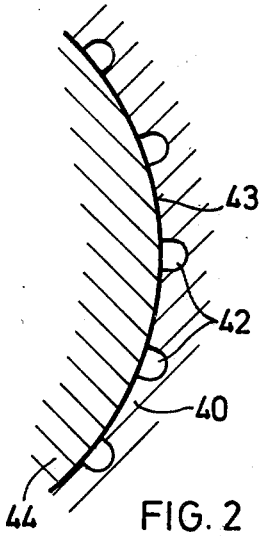
FIG. 2 illustrates a partial view taken on line II—II of FIG. 1.

As shown in FIGS. 1 and 2, the top part of the valve cage 30 has an inwardly directed flange or collar 40 in which a plurality of ducts or grooves 42 are distributed uniformly over the periphery of a contact surface thereof. In addition, the spindle guide 13 has an outwardly directed flange 44 opposite the flange 40 which is provided with a plain contact surface 43 formed as a circular surface of rotation opposed to the contact surface of the cage 30. The flanges 40, 44 are disposed so that there is very slight radial clearance therebetween. In addition, as shown in FIG. 1, an annulus i.e. and annular chamber 50 is formed between the cover 6 and the cage 30 concentric to the valve axis. The annulus 50 is formed above the two flanges 40, 44 and below the shoulder 25 in order to communicate with the water feed duct 7 via a vertical passage 52 at one end and with the ducts 42 at the opposite end.

During operation, steam flows beneath the raised valve head 16 from the inlet 3 into the flow chamber within the cage 30 and undergoes an intensive turbulance. At the same time, water is injected from the annulus 50 into the steam in the flow chamber via the ducts 42. Most of this water evaporates in the chamber while a smaller amount is entrained in the form of small droplets and is carried by the steam through the passages 38 and may be discharged via the outlet duct 4.

The injection water is fed to the annulus 50 via a valve (not shown), line 58, water feed duct 7 and vertical passage 52. The temperature in the annulus 50 is much lower than the temperature of the steam below the flanges 40, 44, particularly during transient states. Consequently, there are considerable temperature differences between the cage 30 and cover 6, particularly in the region of the flange 44 on the spindle guide 13. The high flow velocity of the water in the region of the ducts 42 results in high temperature gradients particularly in the cooling water discharge zone defined by the ducts 42. However, these temperature gradients do not have a destructive effect because there is a separation between the flange 40 (which would tend to shrink relatively outwardly) and the flange 44 (which would tend to shrink relatively inwardly). Thus, the radial clearance between the two flanges increases under these conditions, but not considerably since the slight additional clearance does not essentially increase the total flow cross-section for the water.

Figure 3:
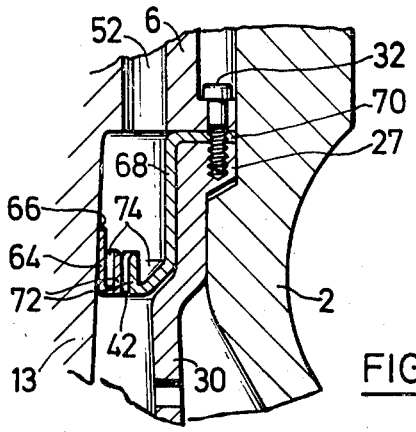
FIG. 3 illustrates a partial axial cross-sectional view through a modified steam throttle valve constructed in accordance with the invention.

Referring to FIG. 3 wherein like reference characters indicate like parts as above, the flanges 40, 44 may be replaced by thin-walled tubular members. As shown, an inner thin-walled channel-section tubular member 64 is pushed over the spindle guide 13 and is secured in place by a weld seam 66. Similarly, a thin-walled outer S-section tubular member 68 is provided on the cage 30. This member 68 also has a flange 70 at the upper end which is clamped between the shoulder 25 of the cover and the top flange 27 of the valve cage 30 via the bolts 32. The members 64, 68 are disposed to contact one another at a cylindrical surface from which grooves 42 forming water injection ducts are contrived in the outer tubular member 68.

In this embodiment, annular chambers 74 are formed adjacent lips 72 of the tubular members 64, 68 to act as traps to receive stagnant water. Thus, when water is stagnated in these chambers 74, there is a zone of relatively low heat transfer on the water side. This, in turn, results in reduced temperature gradients the tubular members 64, 68.

Another advantage of this embodiment is that the outer tubular member 68 can be readily and inexpensively replaced should erosion or corrosion occur therein.

Figure 4:
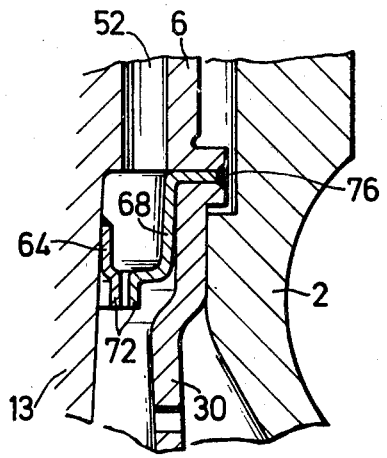
FIG. 4 illustrates a further modification of a steam throttle valve in accordance with the invention.

Referring to FIG. 4, wherein like reference characters indicate like parts as above, the tubular members 64, 68 can be formed so that the lips 72 extend downwardly instead of upwardly. As a result, the members 64, 68 define annular chambers which act as traps for stagnant steam adjacent the lips 72. The temperature of the tubular members 64, 68 can thus be closer to the lower water temperature. Further, the temperature gradients that may be expected are lower than those for the embodiment shown in FIG. 3 because the water temperature, in any case, has the predominant effect on the temperature of the tubular members 64, 68 in the region of the grooves 42.

As shown in FIG. 4, the cover 6, tubular member 68 and valve cage 30 are interconnected by a circular weld seam 76. This seam 76 can be readily removed, for example by grinding or turning, when the valve cage 30 requires replacement. The tubular member 68 is also exposed in such cases and can be replaced or refitted depending upon its condition.

Figure 5:
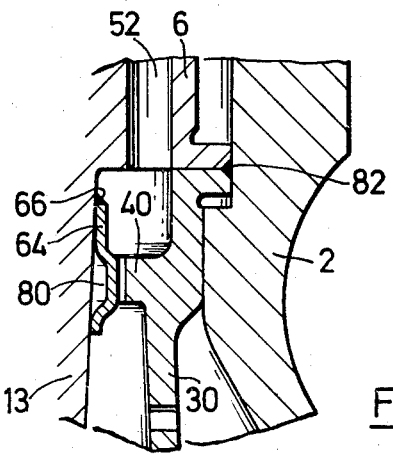
FIG. 5 illustrates a still further modification of a steam throttle valve in accordance with the invention.

Referring to FIG. 5, wherein like reference characters indicate like parts as above, an inner tubular member 64 may be carried on the spindle guide 13 at both ends for cooperation with an inwardly directed flange 40 on the valve cage 30. By mounting the tubular members 64 at both ends, a practically closed annulus 80 is formed. This annulus 80, in turn, axially reduces the temperature gradient at the spindle guide 13. As in FIG. 4, the valve cage 30 is connected to the cover 6 by a circular weld seam 82.

It is to be noted that various tubular members and flanges may be combined in other ways in order to define the cooling water discharge zone so as to give specific advantages, for example with respect to production and installation, removability and costs. There is no difficulty in forming the grooves 42 to follow a conical surface of rotation, the contacting surfaces simply being shaped accordingly. If the conical surface is to widen out in the downward direction, inner and outer tubular members may be provided. In this case, the inner member may be welded at the downstream edge relative to the flow of water as in the embodiment of FIG. 5. Further, the two tubular members, disposed cone to cone, are pushed onto the guide 13 until the flange of the outer member contacts the shoulder 25 of the cover 6.

In order to direct the injected water jets away from the guide 13 and towards the valve cage 30, the grooves 42 are disposed at an angle to the valve axis, for example at an angle of 25°, instead of being parallel thereto. For the same purpose, the grooves 42 may be formed as equal-pitch helices.

Finally, it is to be noted that instead of using the circular weld 66, 76, 82, tack welds may also be utilized.

The invention thus provides a steam throttle valve which can be constructed in a relatively simple manner so as to avoid thermal stresses on the valve seat and valve head.

What is clamed is:

1. A steam throttle valve comprising a valve body having a throttle cross-section disposed on a valve axis about a valve seat;

a valve spindle guide disposed on said valve axis for guiding a valve head relative to said valve seat, said guide having a coaxial contact surface thereon;

a perforated valve cage disposed on said valve axis downstream of said throttle cross-section concentrically about said spindle guide to define a flow chamber therebetween, said cage having a contact surface concentric to and opposite said contact surface of said guide;

a plurality of ducts extending along and between said contact surfaces for directing cooling water into said flow chamber; and an annulus concentric to said valve axis for receiving cooling water and being in communication with said ducts to deliver cooling water into said flow chamber.

2. A steam throttle valve as set forth in claim 1 wherein said contact surface on said guide is a surface of rotation and said ducts are grooves in a collar on said cage.

3. A steam throttle valve as set forth in claim 1 wherein said cage is removably mounted in said body.

4. A steam throttle valve as set forth in claim 1 at least one thin-walled tubular member is mounted on one of said spindle guide and said cage to define one of said contact surfaces and said ducts.

5. A steam throttle valve as set forth in claim 1 which further comprises at least one annulus to define a trap for at least one of stagnant water and stagnant steam in a zone adjacent said ducts.

6. A steam throttle valve as set forth in claim 1 wherein each said duct is disposed at an angle to said valve axis.

7. A steam throttle valve as set forth in claim 1 wherein a thin-walled tubular member is mounted on said spindle guide to define said contact surface thereof and a second thin-walled tubular member is mounted on said cage to define said contact surface thereof and said ducts are formed in at least one of said tubular members.

* * * * *

UNITED STATES PATENT AND TRADEMARK OFFICE

CERTIFICATE OF CORRECTION

PATENT NO. : 4,366,833

DATED : January 4, 1983

INVENTOR(S) :

It is certified that error appears in the above—identified patent and that said Letters Patent is hereby corrected as shown below:

Column 6, line 3, after "1" insert --wherein--

Signed and Sealed this

*Seventh* Day of *June 1983*

[SEAL]

*Attest:*

DONALD J. QUIGG

*Attesting Officer*

*Acting Commissioner of Patents and Trademarks*